US010056052B2

(12) United States Patent
Shin et al.

(10) Patent No.: US 10,056,052 B2
(45) Date of Patent: Aug. 21, 2018

(54) DATA CONTROL CIRCUIT AND FLAT PANEL DISPLAY DEVICE INCLUDING THE SAME

(71) Applicant: LG Display Co., Ltd., Seoul (KR)

(72) Inventors: HoSeop Shin, Gyeonggi-do (KR); HakSu Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 112 days.

(21) Appl. No.: 14/977,982

(22) Filed: Dec. 22, 2015

(65) Prior Publication Data

US 2016/0189600 A1 Jun. 30, 2016

(30) Foreign Application Priority Data

Dec. 31, 2014 (KR) ..... 10-2014-0195982

(51) Int. Cl.
*G09F 3/20* (2006.01)
*G09G 3/36* (2006.01)
*G09G 3/3225* (2016.01)

(52) U.S. Cl.
CPC ..... *G09G 3/3688* (2013.01); *G09G 3/3225* (2013.01); *G09G 3/3614* (2013.01); *G09G 2230/00* (2013.01); *G09G 2310/0254* (2013.01); *G09G 2310/0297* (2013.01)

(58) Field of Classification Search
CPC .. G09G 3/3688; G09G 3/3225; G09G 3/3614; G09G 2310/0254; G09G 2310/0297
USPC ..... 345/209–212
See application file for complete search history.

(56) References Cited

U.S. PATENT DOCUMENTS

| | | | | |
|---|---|---|---|---|
| 6,333,729 | B1 | 12/2001 | Ha | |
| 7,557,783 | B2 * | 7/2009 | Kim | G09G 3/3233 345/100 |
| 7,728,827 | B2 * | 6/2010 | Shin | G09G 3/3283 345/204 |
| 8,477,127 | B2 * | 7/2013 | Tanaka | G09G 3/3648 345/209 |
| 2003/0090614 | A1 * | 5/2003 | Kim | G09G 3/3688 349/149 |
| 2003/0179164 | A1 * | 9/2003 | Shin | G09G 3/3233 345/76 |

(Continued)

FOREIGN PATENT DOCUMENTS

| | | |
|---|---|---|
| CN | 1514424 A | 7/2004 |
| CN | 1525217 A | 9/2004 |

(Continued)

OTHER PUBLICATIONS

First Notification of Office Action dated Feb. 27, 2018 from The State Intellectual Property Office of China in related Chinese patent application No. 201510998423.1.

*Primary Examiner* — Benyam Ketema
(74) *Attorney, Agent, or Firm* — Morgan, Lewis & Bockius LLP

(57) ABSTRACT

A data control circuit includes a MUX driver that electrically connects a first channel of a data driver and one of the pixels in a first pixel group of a display panel in response to a first control signal, and electrically connects a second channel of the data driver and one of the pixels in a second pixel group of the display panel in response to a second control signal; and a MUX controller that outputs the first and second control signals.

10 Claims, 5 Drawing Sheets

(56) References Cited

U.S. PATENT DOCUMENTS

| | | | | |
|---|---|---|---|---|
| 2004/0125065 | A1* | 7/2004 | Park | G09G 3/20 345/92 |
| 2004/0179014 | A1 | 9/2004 | Nakano et al. | |
| 2005/0110727 | A1* | 5/2005 | Shin | G09G 3/20 345/76 |
| 2005/0134541 | A1* | 6/2005 | Jang | G09G 3/3688 345/94 |
| 2006/0071884 | A1* | 4/2006 | Kim | G09G 3/3233 345/76 |
| 2006/0238134 | A1 | 10/2006 | Park et al. | |
| 2007/0057877 | A1* | 3/2007 | Choi | G09G 3/3233 345/76 |
| 2007/0268233 | A1 | 11/2007 | Hashimoto et al. | |
| 2011/0175858 | A1* | 7/2011 | Lee | G09G 3/3688 345/204 |
| 2013/0141320 | A1* | 6/2013 | Kim | G09G 3/3685 345/92 |
| 2013/0293520 | A1* | 11/2013 | Hsiao | G09G 3/02 345/204 |
| 2014/0092076 | A1* | 4/2014 | Lee | G09G 3/3291 345/212 |
| 2014/0160172 | A1 | 6/2014 | Lee | |
| 2015/0161927 | A1* | 6/2015 | Hekstra | G09G 3/3614 345/209 |

FOREIGN PATENT DOCUMENTS

| | | | |
|---|---|---|---|
| CN | 1841470 | A | 10/2006 |
| CN | 1932939 | A | 3/2007 |
| CN | 101075417 | A | 11/2007 |
| CN | 101123073 | A | 2/2008 |
| CN | 103871357 | A | 6/2014 |

* cited by examiner

DATA CONTROL CIRCUIT AND FLAT PANEL DISPLAY DEVICE INCLUDING THE SAME

CROSS-REFERENCE TO RELATED APPLICATIONS

Pursuant to 35 U.S.C. § 119(a), this application claims the benefit of earlier filing date and right of priority to Korean Patent Application No. 10-2014-0195982, filed on Dec. 31, 2014 the contents of which is incorporated by reference herein in its entirety.

BACKGROUND OF THE INVENTION

1. Field of the Invention

The present invention relates to a flat panel display device, and more particularly, to a data control circuit for a flat panel display device and a flat panel display device having a data control circuit.

2. Description of the Related Art

With the development of various kinds of portable devices such as mobile phones or laptops and information electronic devices for implementing high-resolution, high-quality images such as HDTV, the demand for flat panel display devices for use in these devices is growing. Examples of these flat panel display devices include liquid crystal displays (LCDs), plasma display panels (PDPs), field emission displays (FEDs), and organic light-emitting diodes (OLEDs).

Typically, a flat panel display device includes a plurality of gate lines and a plurality of data lines intersecting the gate lines that are formed on a display panel. A plurality of pixels including thin film transistors, which are driving elements, are formed at the intersections of the two types of lines. Each pixel has an electric current passing through it by a signal applied from the gate lines, and displays an image in response to a signal applied from the data lines.

Therefore, at least one gate line and at least one data line have to be connected to each pixel, at least one data line is allocated to pixels arranged in the same horizontal line, and each data line has to be connected one-to-one to one channel of a data driver that supplies video-related signals.

However, in line with the trend of flat panel display devices with large surface area and high resolution, the number of data lines is increasing. To cope with this, the number of channels of the data driver is also increasing, and the internal logic becomes complicated, leading to an increase in the manufacturing cost of the data driver.

To overcome this problem, there was suggested a structure that enables the data driver to use fewer channels by sharing one channel between two or more second lines.

FIG. 1 is a view schematically showing part of a related art channel-reduced flat panel display device. The following drawing illustrates an application example of a 3×1 multiplexer structure that connects three data lines to a single channel.

As shown therein, the related art channel-reduced flat panel display device includes data lines DL1 to DL6 connected to a plurality of pixels and a MUX driver 50 that connects two channels ch1 and ch2 of the data driver 20.

The MUX driver 50 offers the advantage of reducing the number of channels Chn of the data driver to one-third of the related art one by time-dividing one horizontal period 1H into three parts and selectively connecting the data lines DL1 to DL6 and the channels ch1 and ch2, in response to control signals $S_{MUX}$1 to $S_{MUX}$3 applied from a MUX controller (not shown) provided in the outside. For each control signal $S_{MUX}$1 to $S_{MUX}$3, one data line DL1 to DL6 and one channel ch1 and ch2 are electrically connected. For example, when the first control signal $S_{MUX}$1 is applied, the first data line DL1 and the first channel ch1 are connected.

The voltage level of the control signals $S_{MUX}$1 to $S_{MUX}$3 for driving the MUX driver 50 has a difference of about 3.0 V from a data voltage applied through the data lines D1 to DL6. For example, according to polarity inversion driving, a positive (+) data voltage ranges from +5.0 V to −5.0 V, and a negative (−) data voltage ranges from 0 V to −5 V. Since the voltage level of the control signals $S_{MUX}$1 to $S_{MUX}$3 has a difference of about 3.0 V from the data voltages, as described above, the actual voltage level ranges from about 9.0 V to 9.0 V, with a difference of 1.0 V from the data voltages.

That is, the control signals $S_{MUX}$1 to $S_{MUX}$3 are within the range of about +9 V to −9 V, regardless of data polarity, and are applied to the MUX driver 50, with a voltage swing width of 18 V every ⅓ horizontal period.

Accordingly, the power consumed to apply a control signal to the MUX driver 50 having the structure of FIG. 1 can be expressed by the multiplication of the capacitance of control lines to which a control signal is applied, the frequency F of the control signal, the difference Vsupply between the high and low levels of a voltage supplied to the control lines, and the voltage swing Vswing of the control signal.

$$\text{power}=C\times F\times V\text{supply}\times V\text{swing}$$

$$\text{power}=C\times F\times 324 \qquad \text{[Equation 1]}$$

That is, the related art MUX driver 50 has the drawback that the large voltage difference between two neighboring control lines and the large voltage swing can lead to a delay in the rising time and falling time of switching elements constituting the MUX driver 50, thus causing malfunction and high power consumption.

SUMMARY

Accordingly, the present invention is directed to a data control circuit and a flat panel display device including the same that substantially obviates one or more of the problems due to limitations and disadvantages of the related art.

An object of the present invention is to provide a data control circuit which prevents malfunction of a reduced-channel flat panel display device, caused by the large voltage swing of a control signal, and consumes less power, and a flat panel display device including the same.

Another object of the present invention is to provide a data control circuit with less power consumption that minimizes malfunctioning of a channel-reduced flat panel display device, and a flat panel display device including the same.

Another object of the present invention is to provide a data control circuit that is provided between a data driver and a display panel, and a flat panel display device including the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a data control circuit comprises a MUX driver that electrically connects a first channel of a data driver and one of the pixels in a first pixel group of a display panel in response to a first control signal, and electrically connects a second channel of the data driver and one of the pixels in a second pixel group of the display panel in response to a second control signal; and a MUX controller that outputs the first and second control signals.

In another aspect, a flat panel display device comprises a display panel including a first pixel group that operates with a first polarity and a second pixel group that operates with a second polarity; a data driver including first and second channels that supply the first and second pixel groups with a data voltage for a video; a data drive circuit including a MUX driver and a MUX controller for outputting the first and second control signals, the MUX driver electrically connecting the first channel and one of the pixels in the first pixel group in response to the first control signal, and electrically connecting the second channel and one of the pixels in the second pixel group in response to the second control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE ILLUSTRATED EMBODIMENTS

The features of various embodiments of the present invention can be partly or fully incorporated or combined with one another and work or operate in conjunction in various ways in terms of technology, and the embodiments can be implemented either alone or in association with one another.

Figure 1:
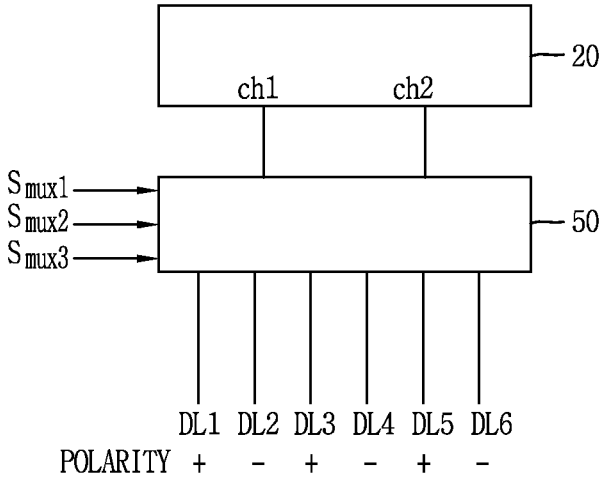
FIG. 1 RELATED ART
FIG. 1 is a view schematically showing part of a related art channel-reduced flat panel display device.
Figure 2:
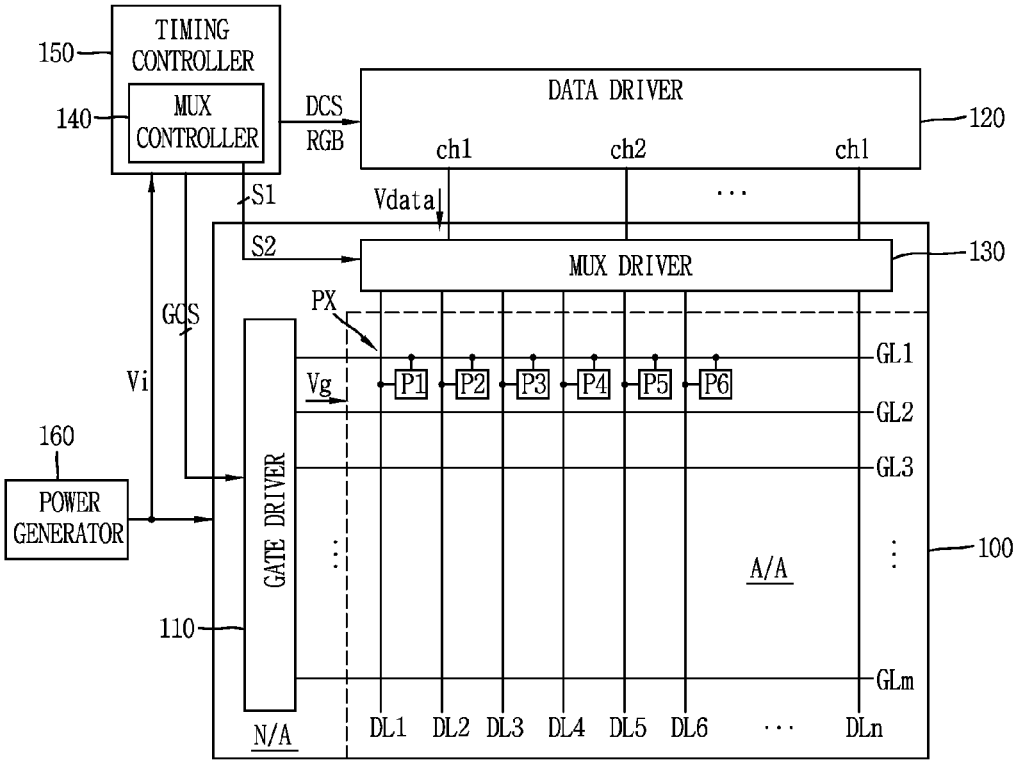
FIG. 2 is a view showing the entire structure of a flat panel display device including a data control circuit according to an exemplary embodiment of the present invention.

FIG. 2 is a view showing the entire structure of a flat panel display device including a data control circuit according to an exemplary embodiment of the present invention.

Referring to FIG. 2, a flat panel display device including a data control circuit according to an exemplary embodiment of the present invention includes a display panel 100 including a first pixel group that operates with a first polarity and a second pixel group that operates with a second polarity, a gate driver 110 that supplies a gate driving voltage Vg to the first and second pixel groups, a data driver 120 including first and second channels ch1 and ch2 that supply the first and second pixel groups with a data voltage Vdata for a video, a data drive circuit 130 and 140 including a MUX driver 130 and a MUX controller 140 for outputting the first and second control signals s1 and s2, the MUX driver 130 electrically connecting the first channel ch1 and one of the pixels in the first pixel group in response to a first control signal s1 and electrically connecting the second channel ch2 and one of the pixels in the second pixel group in response to a second control signal s2, a timing controller 150 that controls the drivers 110 and 120, and a power generator 160 that generates and supplies one or more voltages for driving to the drivers and controller 110 to 150.

The display panel 100 includes a plurality of gate lines GL1 to GLm and a plurality of data lines DL1 to DLn formed on a substrate made of glass or plastic and intersecting in a matrix form, and a plurality of pixels PX defined at the intersections. The pixels PX are arranged in a matrix form, and each pixel may consist of three subpixels corresponding to three primary colors R, G, and B or four subpixels corresponding to three primary colors and white W. In the drawing, first to sixth pixels P1 to P6, out of all the pixels, are illustrated.

The display panel 100 may be divided into an active area A/A where the pixels PX are arranged and a non-active area N/A which is the periphery outside the active area A/A.

Examples of a flat panel display device according to an exemplary embodiment of the present invention may include a liquid crystal display LCD in which each pixel includes at least one thin film transistor and a liquid crystal capacitor or an organic light-emitting display OLED in which each pixel includes at least two thin film transistors, a storage capacitor, and an organic light emitting diode.

In case of the liquid crystal display, a gate terminal of the thin film transistor is connected to the gate lines GL1 to GLm, a drain terminal thereof is connected to the data lines DL1 to DLn, and a source terminal thereof is connected to a pixel electrode facing a common electrode, thereby defining a single pixel. Amorphous silicon (a-si silicon) is widely used as a material of an active layer of the thin film transistor. Otherwise, polysilicon or oxide semiconductor may be used in consideration of the properties of the thin film transistor.

In case of the organic light-emitting display, two or more thin film transistors are provided. Thus, the gate lines GL1 to GLm are connected to a gate terminal of one of the thin film transistors, and a source terminal of this thin film transistor may be connected to the other thin film transistor.

The gate driver 110 sequentially outputs a gate driving signal Vg for each horizontal period 1H through the gate lines GL1 to GLm formed on the liquid crystal panel 100, in response to a gate control signal GCS input from the timing controller 130. Accordingly, the thin film transistors connected to the gate lines GL1 to GLm are turned on for each horizontal period, and the data driver 120 outputs a data voltage Vdata of an analog waveform through the data lines DL1 to DLn in synchronization with the turn-on and apply it to the pixels PX connected to the thin film transistors. The gate driver 110 may be mounted in the form of thin film transistors in the non-active area N/A of the display panel 100.

The gate control signal GCS supplied to the gate driver 110 includes a gate start pulse GSP, a gate shift clock GSC, a gate output enable GOE, etc.

The data driver 120 converts an aligned digital video signal RGB, which is input in response to a data control signal DCS from the timing controller 150, to an analog data voltage Vdata based on a reference voltage, and outputs the analog data voltage Vdata to the pixels PX. The above-mentioned data voltage Vdata is latched for each horizontal line, and time-divided for each ⅓ horizontal period ⅓H of one horizontal line and supplied to the display panel 100 through the data lines DL1 to DLm.

The data control signal DCS may include a source start pulse SSP, a source shift clock SSC, a source output enable signal SOE, etc.

Particularly, the number of channels ch1 to chl of the data driver 120 is one-third of the number of data lines DL1 to DLn, and the channels Ch1 to Chl are connected to all the data lines DL1 to DLn through the MUX driver 130.

As for the channels ch1 to chn of the data driver 120, the MUX driver 130 connects one channel and three data lines DL1 to DLn on the display panel 100 in an alternating fashion, in response to first and second control signals S1 and S2. A method of connecting the channels ch1 to chn and the data lines DL1 to DLn during 1 horizontal period 1H will be described. First, in response to the first and second control signals S1 and S2, the first channel ch1 and the second channel ch2 are connected to the first data line DL1 and the fourth data line D L4, respectively, during the first ⅓ horizontal period ⅓H, and the first channel ch1 and the second channel ch2 are connected to the second data line DL2 and the fifth data line DL5, respectively, during the next ⅓ horizontal period. Then, the first channel ch1 and the second channel ch2 are connected to the third data line DL3 and the sixth data line DL6, respectively, during the last ⅓ horizontal period. In this instance, the data voltage Vdata applied to neighboring pixels has different polarities due to inversion driving, and electric current passes sequentially through the first and second pixels P1 and P2, the third and fourth pixels P3 and P4, and the fifth and sixth pixels P5 and P6, with the first, third, and fifth pixels P1, P3, and P5 having a different polarity from the second, fourth, and sixth pixels P2, P4, and P6. As the first, third, and fifth pixels P1, P3, and P5 are connected to the first channel ch1 and the second, fourth, and sixth channels P2, P4, and P6 are connected to the second channel ch2, the data voltage applied to one channel during 1 horizontal period has one polarity. Thus, the voltage level changes little, thereby allowing for stable charging of each pixel PX and resulting in a reduction in power consumption. Moreover, as the same polarity is maintained during 1 horizontal period, control signals S1 and S2 in the same range are applied to the MUX transistors (not shown) of the MUX driver 130. This allows for stable voltage charging of the gate terminals and a further reduction in power consumption.

The MUX driver 130 may be mounted in the form of thin film transistors like the gate driver 110, in the non-active area N/A of the display panel 100.

The MUX controller 140 serves to output control signals S1 and S2 to the MUX driver 130 according to the timing of charging each pixel PX and sequentially connects the channels ch1 to chn and the data lines DL1 to DLn.

The MUX controller 140 outputs the first and second control signals S1 and S2 with a high-voltage potential during the first ⅓ horizontal period ⅓H and charges the first and second pixels P1 and P2 with a data voltage Vdata through the first and second channels ch1 and ch2 to allow them to have different polarities. Likewise, the third and fourth pixels P3 and P4 and the fifth and sixth pixels P5 and P6 are charged in the same manner. Thus, the first and second control signals S1 and S2 are kept at the same voltage level during 1 horizontal period 1H, resulting in a reduction in power consumption.

The timing controller receives a timing signal from an external system (not shown), generates control signals for the gate driver 110, data driver 120, and MUX driver 130, and aligns transmitted digital video-related data and supplies video data RGB to the data driver 120.

The power generator 160 supplies various operating voltages and ground voltages required to operate the display panel 100, the gate and data drivers 110 and 120, the MUX driver 130, and the timing controller 150.

Particularly, in an exemplary embodiment of the present invention, the MUX driver 130 has the same device characteristics as the gate driver 110 because it is mounted in the form of thin film transistors like the gate driver 110, on the display panel 100. Accordingly, the power generator 160 is not configured to generate a voltage for control, but instead an input voltage Vi for driving the gate driver 110 may be used.

In an example, the voltage for driving the MUX transistors of the MUX driver 130 has a difference of about 3.0 V from the data voltage, and the positive data voltage Vdata is about 5.0 to 0 V. Therefore, the operating voltage of the MUX driver 130 required to output the data voltage is about +8.0 V to −3.0 V. Also, the negative data voltage Vdata is about 0 V to −5.0 V. Therefore, the operating voltage of the MUX driver 130 required to output the data voltage is about +3.0 V to −8.0 V.

The input voltage Vi of the gate driver 110 may be normally set to between 9.0 V and −9.0 V. Accordingly, the operating voltage of the MUX driver 130 may be set to between 9.0 V to −5.0 V for positive driving and between +5.0 V to −9.0 V for negative driving.

Besides, if the output voltage of the voltage generator 160 can be set to various levels, the low level for positive driving may be set to −1.8 V or −3.0 V, rather than −5.0 V, and the high level for negative driving may be set to 1.8 V or 3.0 V, rather than +5.0 V.

For a positive voltage range of 9.0 V to −5.0 V and a negative voltage range of +5.0 V to −9.0 V, the power consumption is expressed by the following Equation 2:

$$\text{power}=C\times F\times V\text{supply}\times V\text{swing2}$$

$$\text{power}=C\times F\times 252 \qquad \text{[Equation 2]}$$

where Vsupply and Vswing2 each are 14 V, by which a 22.5% reduction can be achieved compared to the related art power consumption.

For a positive voltage range of 9.0 V to −1.8 V and a negative voltage range of +1.8 V to −9.0 V, the power consumption is expressed by the following Equation 3:

$$\text{power}=C\times F\times V\text{supply}\times V\text{swing3}$$

$$\text{power}=C\times F\times 194.4 \qquad \text{[Equation 3]}$$

where Vsupply and Vswing2 each are 10.4 V, by which a 40% reduction can be achieved compared to the related art power consumption.

As described above, if the output voltage of the power generator 160 is properly set, the power consumption can be further reduced.

Hereinafter, the structure and operation of the MUX driver of the data control circuit according to an exemplary embodiment of the present invention will be described in detail with reference to the drawings.

Figure 3:
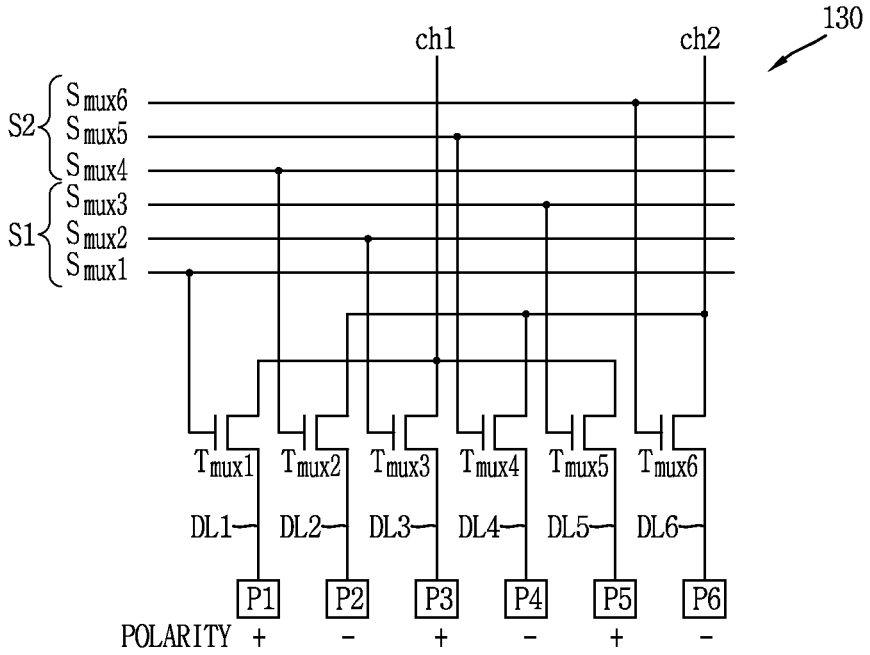
FIG. 3 is a view showing some of MUX transistors constituting a MUX driver according to an exemplary embodiment of the present invention.
Figure 4:
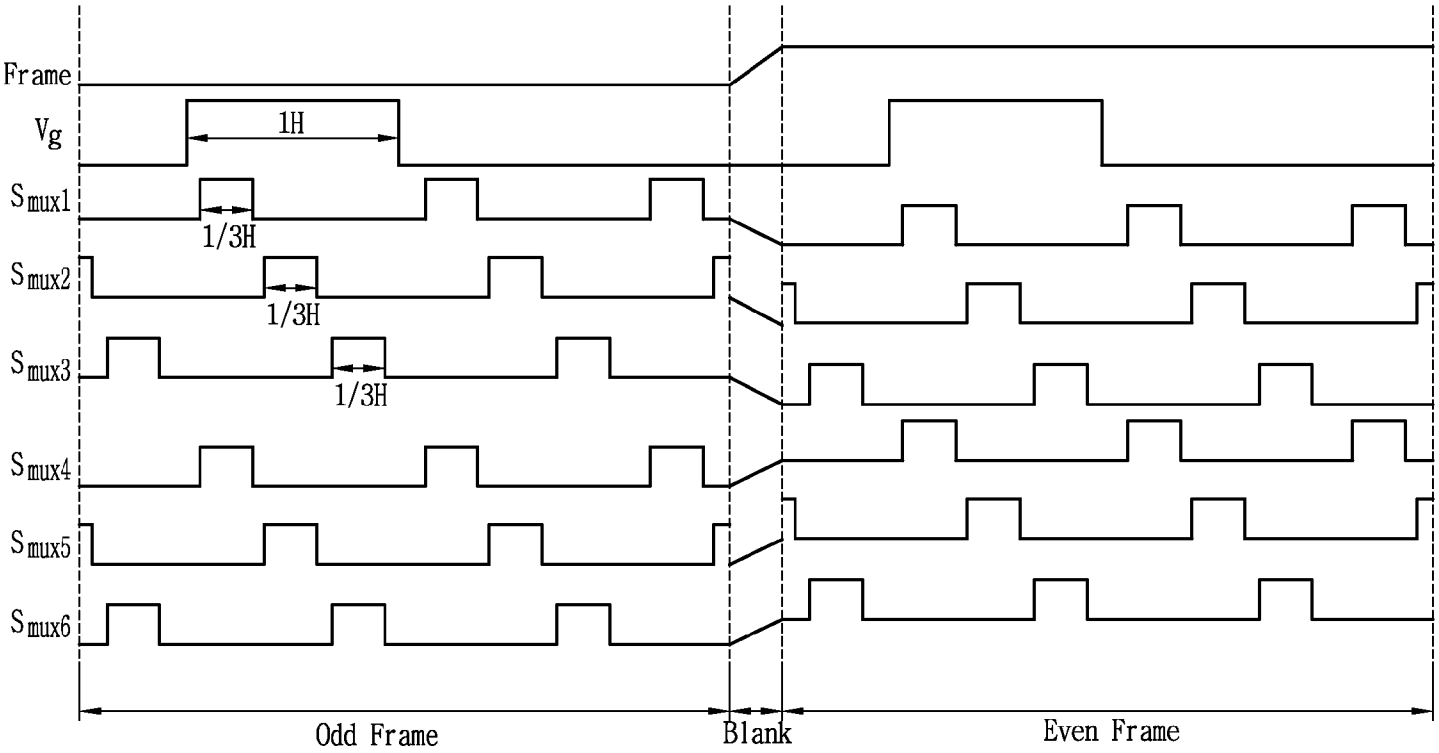
FIG. 4 is a view showing signal waveforms during driving of a flat panel display device according to an exemplary embodiment of the present invention.

FIG. 3 is a view showing some of MUX transistors constituting a MUX driver according to an exemplary embodiment of the present invention. FIG. 4 is a view showing signal waveforms during driving of a flat panel display device according to an exemplary embodiment of the present invention.

Referring to FIGS. 3 and 4, the MUX driver 130 according to an exemplary embodiment of the present invention includes first to sixth MUX transistors Tmux1 to Tmux6 that are respectively connected to 6 pixels P1 to P6 arranged side by side and have electric current passing through them upon receiving first and second control signals s1 and s2.

Concretely, the MUX driver 130 is driven upon receiving first and second control signals s1 and s2 from the MUX controller (140 of FIG. 2). The first control signal S1 is classified into first to third MUX signals Smux1 to Smux3, and the second control signal S2 is classified into fourth to sixth MUX signals Smux4 to Smux6.

The gates of the first to sixth MUX transistors Tmux1 to Tmux6 are connected to the supply lines of the first to sixth MUX signals Smux1 to Smux6, respectively. The drain terminals of the first to third MUX transistors Tmux1 to Tmux3 are connected to the first channel ch1, and their source terminals are connected to the first to third pixels P1 to P3 through the first to third data lines DL1 to DL3.

The drain terminals of the fourth to sixth MUX transistors Tmux4 to Tmux6 are connected to the second channel ch2, and their source terminals are connected to the second channel ch2.

A method of driving the MUX driver 130 having this structure will be explained. First, inversion driving is implemented in odd and even frames in response to a frame synchronization signal Frame, which is a timing signal for a flat panel display device. In an example, for odd frames, the first to third MUX transistors Tmux1 to Tmux3 operate with a positive polarity and the fourth to sixth MUX transistors Tmux4 to Tmux6 operate with a negative polarity, and for even frames, the first to third MUX transistors Tmux1 to Tmux3 and the fourth to sixth MUX transistors Tmux4 to Tmux6 operate with the opposite polarity.

Meanwhile, a high-level gate driving signal Vg is sequentially output, and a data voltage is applied to pixels corresponding to one horizontal line during 1 horizontal period 1H defined by one gate driving signal Vg.

During the first ⅓ horizontal period ⅓H, the first to fourth MUX signals Smux1 to Smux4 are input at high level to apply a positive data voltage (+) and a negative data voltage (−) to the first and fourth pixels P1 and P4, respectively. During the next ⅓ horizontal period, the second and fifth MUX signals Smux2 and Smux5 are input at high level to apply a positive data voltage (+) and a negative data voltage (−) to the second and fifth pixels P2 and P5. During the last ⅓ horizontal period, voltages are likewise applied to the third and sixth pixels P3 and P6. In the even frames, although the pixels are charged in the same order as the odd frames, the data voltages applied to the pixels have the opposite polarity.

Accordingly, each channel ch1 and ch2 outputs voltages of the same polarity during one horizontal period 1H, thus reducing the voltage swing. This leads to a decrease charging time according to polarity inversion in pixel and a reduction in power consumption.

Hereinafter, the wiring and electrode structure of the MUX driver according to an exemplary embodiment of the present invention will be described with reference to the drawings.

Figure 5:
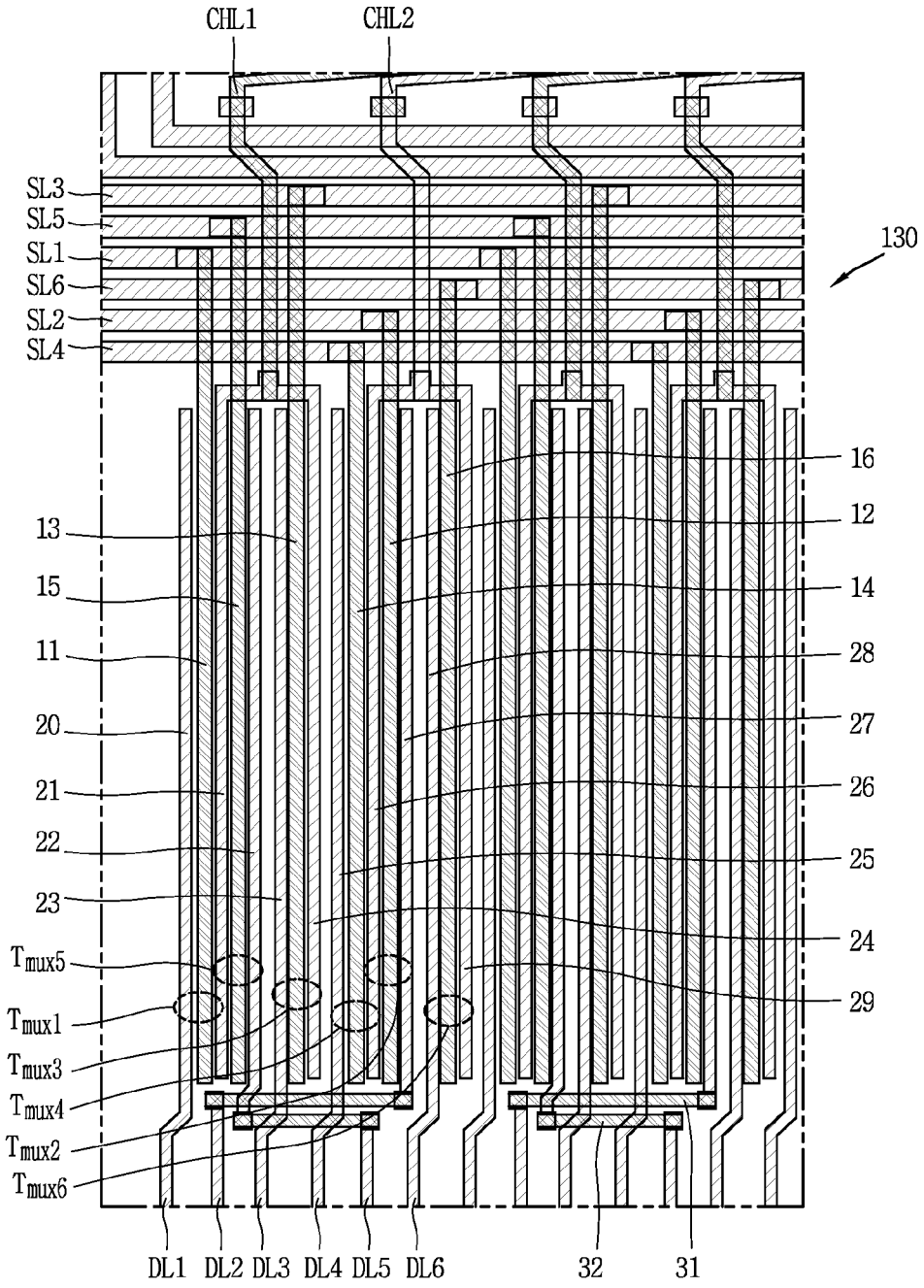
FIG. 5 is a top plan view of the structure of a MUX driver of a flat panel display device according to an exemplary embodiment of the present invention.

FIG. 5 is a top plan view of the structure of a MUX driver of a flat panel display device according to an exemplary embodiment of the present invention.

Referring to FIG. 5, in the MUX driver 130 of the flat panel display device according to the present invention, first to sixth MUX signal lines SL1 to SL6 to which first to sixth MUX signals are applied are formed side by side in a row, and the MUX signal lines SL1 to SL6 are connected to the gate electrodes 11 to 16 of the first and sixth MUX transistors Tmux1 to Tmux6, respectively.

The drain electrodes and source electrodes 20 to 29 of the first to sixth MUX transistors Tmux1 to Tmux6 are connected to the first and second channel lines CHL1 and CHL2 and the first to sixth data lines DL1 to DL6.

The first to sixth data lines DL1 to DL6, the drain electrodes and source electrodes 20 to 29 of the first to sixth MUX transistors Tmux1 to Tmux6, and the data lines DL1 to dL6 are formed of the same data metal layer, and the gate electrodes 11 to 16 and connecting lines 31 and 32 are formed of the same gate metal layer.

Hereinafter, the structure of the MUX driver 130 will be described in detail for each MUX transistor.

First, the first MUX transistor Tmux1 includes the gate electrode 11, the source electrode 20, and the drain electrode 21. The gate electrode 11 extends to be connected to the first MUX signal line SL1 through a contact hole, and the source electrode 20 extends to be connected to the first data line DL1. The drain electrode 21 extends to form a ⊓-shape, and is connected to the drain electrode 24 of the third MUX transistor Tmux3 to be described later and at the same time to the first channel line CHL1 through a contact hole.

The drain electrode 21 of the first MUX transistor Tmux1 is also used as the drain electrode 21 of the fifth MUX transistor Tmux5. That is, the MUX transistors of this invention have a structure in which two neighboring transistors share a single electrode.

The second MUX transistor Tmux2 includes the gate electrode 12, the source electrode 27, and the drain electrode 26. The gate electrode 12 extends to be connected to the second MUX signal line SL2 through a contact hole, and the source electrode 27 extends to be connected to the second data line DL2 through the connecting line 31. The drain electrode 26 extends to form a ⊓-shape, and is connected to the drain electrode 29 of the sixth MUX transistor Tmux6 and at the same time to the second channel line CHL2 through a contact hole.

The third MUX transistor Tmux3 includes the gate electrode 13, the source electrode 27, and the drain electrode 26. The gate electrode 13 extends to be connected to the third MUX signal line SL3 through a contact hole, and the source electrode 23 extends to be connected to the third data line DL3. The drain electrode 24 is connected to the first channel line CHL1 and the drain electrode 22 of the first MUX transistor Tmux1.

The fourth MUX transistor Tmux4 includes the gate electrode 14, the source electrode 25, and the drain electrode 26. The gate electrode 14 extends to be connected to the fourth MUX signal line SL4 through a contact hole, and the source electrode 25 extends to be connected to the fourth data line DL4. The drain electrode 26 extends to form a ⊓-shape, and is connected to the drain electrode 29 of the sixth MUX transistor Tmux6 and at the same time to the second channel line CHL2 through a contact hole.

The fifth MUX transistor Tmux5 includes the gate electrode 15, the source electrode 22, and the drain electrode 21. The gate electrode 15 extends to be connected to the fifth MUX signal line SL5 through a contact hole, and the source electrode 22 extends to be connected to the fifth data line DL5 through the connecting line 32. The drain electrode 21 is connected to the first channel line CHL1 and at the same time shared with the first MUX transistor Tmux1.

The sixth MUX transistor Tmux6 includes the gate electrode 16, the source electrode 28, and the drain electrode 29. The gate electrode 16 extends to be connected to the sixth MUX signal line SL6 through a contact hole, and the source electrode 28 extends to be connected to the sixth data line DL6. The drain electrode 29 is connected to the second channel line CHL2 and the drain electrode 26 of the fourth MUX transistor Tmux4.

In accordance with example embodiments of the present invention, a data control circuit may include a MUX driver that is provided between a channel of a data driver and a data line to selectively connect them in such a way that a data voltage has the same polarity within at least 1 horizontal period to minimize voltage swing.

A data control circuit and a flat panel display device including the same according to exemplary embodiments of the present invention may provide advantages. For example, data control circuit and a flat panel display device according to example embodiments of the present invention may prevent malfunctions and consume less power because the voltage swing of a control signal can be reduced by controlling switching elements of a MUX driver separately by polarity, in a flat panel display device that uses fewer channels by sharing one channel between two or more data lines.

It will be apparent to those skilled in the art that various modifications and variations can be made in the data control circuit and the flat panel display device including the same of the present invention without departing from the spirit or scope of the invention. Thus, it is intended that the present invention cover the modifications and variations of this invention provided they come within the scope of the appended claims and their equivalents.

What is claimed is:

1. A data control circuit, comprising:

a MUX driver that electrically connects a first channel of a data driver and one of the pixels in a first pixel group of a display panel in response to a first control signal, and electrically connects a second channel of the data driver and one of the pixels in a second pixel group of the display panel in response to a second control signal; and a MUX controller that outputs the first and second control signals, wherein the first control signal includes a first plurality of MUX signals each corresponding to respective pixels of the first pixel group, wherein the second control signal includes a second plurality of MUX signals each corresponding to respective pixels of the second pixel group, and wherein the first and second control signals are set to a voltage level between +8 V and −3.0 V if a data voltage has a positive polarity and a voltage level between +3.0 V and −8 V if the data voltage has a negative polarity.

2. The data control circuit of claim 1, wherein the MUX driver comprises:

first, third, and fifth switching transistors including each of gate terminals to which the first control signal is applied, each of drain terminals connected to the first channel, and each of source terminals connected to the pixels in the first pixel group; and second, fourth, and sixth switching transistors including each of gate terminals to which the second control signal is applied, each of drain terminals connected to the second channel, and each of source terminals connected to the pixels in the second pixel group.

3. The data control circuit of claim 1, wherein the first and second control signals have the same voltage swing.

4. The data control circuit of claim 1, wherein the first and second control signals have opposite polarities.

5. The data control circuit of claim 1, wherein the first and second control signals are three-phase signals, whose high levels sequentially alternate for each ⅓ horizontal period.

6. The data control circuit of claim 1, wherein the first and second pixel groups are connected to a gate driver that supplies a gate high voltage and a gate low voltage, and the maximum voltage level and minimum voltage level of the first and second control signals correspond to the gate high voltage and gate low voltage.

7. A flat panel display device, comprising:

a display panel including a first pixel group that operates with a first polarity and a second pixel group that operates with a second polarity;

a data driver including first and second channels that supply the first and second pixel groups with a data voltage for a video;

a data drive circuit including a MUX driver and a MUX controller for outputting first and second control signals, the MUX driver electrically connecting the first channel and one of the pixels in the first pixel group in response to the first control signal, and electrically connecting the second channel and one of the pixels in the second pixel group in response to the second control signal, wherein the first control signal includes a first plurality of MUX signals each corresponding to respective pixels of the first pixel group, wherein the second control signal includes a second plurality of MUX signals each corresponding to respective pixels of the second pixel group, and wherein the first and second control signals are set to a voltage level between +8 V and −3.0 V if a data voltage has a positive polarity and a voltage level between +3.0 V and −8 V if the data voltage has a negative polarity.

8. The flat panel display device of claim 7, wherein the first pixel group includes first, third, and fifth pixels and the second pixel group includes second, fourth, and sixth pixels, wherein the first plurality of MUX signals of the first control signal includes first to third MUX signals respectively corresponding to the first pixel group, and wherein the first plurality of MUX signals of the second control signal includes fourth to sixth MUX signals respectively corresponding to the second pixel group.

9. The data control circuit of claim 1, wherein the first pixel group includes first, third, and fifth pixels and the second pixel group includes second, fourth, and sixth pixels, wherein the first plurality of MUX signals of the first control signal includes first to third MUX signals respectively corresponding to the first pixel group, and wherein the first plurality of MUX signals of the second control signal includes fourth to sixth MUX signals respectively corresponding to the second pixel group.

10. A data control circuit, comprising:

a MUX driver that electrically connects a first channel of a data driver and one of the pixels in a first pixel group of a display panel in response to a first control signal, and electrically connects a second channel of the data driver and one of the pixels in a second pixel group of the display panel in response to a second control signal; and a MUX controller that outputs the first and second control signals, wherein the first and second control signals are set to a voltage level between +8 V and −3.0 V if a data voltage has a positive polarity and a voltage level between +3.0 V and −8 V if the data voltage has a negative polarity.

* * * * *